US010269253B2

(12) United States Patent
Borgyos

(10) Patent No.: US 10,269,253 B2
(45) Date of Patent: Apr. 23, 2019

(54) SYSTEM AND METHOD OF REFINING TRAJECTORIES FOR AIRCRAFT

(71) Applicant: GE Aviation Systems LLC, Grand Rapids, MI (US)

(72) Inventor: Szabolcs Andras Borgyos, Wyoming, MI (US)

(73) Assignee: GE Aviation Systems LLC, Grand Rapids, MI (US)

( * ) Notice: Subject to any disclaimer, the term of this patent is extended or adjusted under 35 U.S.C. 154(b) by 329 days.

(21) Appl. No.: 14/801,494

(22) Filed: Jul. 16, 2015

(65) Prior Publication Data

US 2017/0018192 A1 Jan. 19, 2017

(51) Int. Cl.
*G08G 5/00* (2006.01)

(52) U.S. Cl.
CPC ..... *G08G 5/0039* (2013.01); *G08G 5/0013* (2013.01); *G08G 5/0021* (2013.01); *G08G 5/0026* (2013.01); *G08G 5/0043* (2013.01); *G08G 5/0078* (2013.01); *G08G 5/0082* (2013.01)

(58) Field of Classification Search
CPC .. G08G 5/0013; G08G 5/0021; G08G 5/0026; G08G 5/0039; G08G 5/0043; G08G 5/0078; G08G 5/0082
See application file for complete search history.

(56) References Cited

U.S. PATENT DOCUMENTS 6,463,383 B1 * 10/2002 Baiada ..... G06Q 10/06 342/36
7,151,999 B2 12/2006 Neregard
8,798,898 B2 * 8/2014 Castillo-Effen ..... G08G 5/0095 701/120
2003/0050746 A1 * 3/2003 Baiada ..... G08G 5/0043 701/3
2003/0139875 A1 * 7/2003 Baiada ..... G08G 5/0043 701/120
2004/0193362 A1 * 9/2004 Baiada ..... G08G 5/0013 701/120
2013/0090787 A1 4/2013 Rye et al.
2015/0057915 A1 * 2/2015 La Civita ..... G08G 5/0026 701/120

FOREIGN PATENT DOCUMENTS

EP 1 428 195 B1 10/2005

OTHER PUBLICATIONS

Kantas, N., et al., "Simulation Based Bayesian Optimal Design of Aircraft Trajectories for Air Traffic Management," International Journal of Adaptive Control and Signal Processing, Copyright © 2010 John Wiley & Sons, Ltd., pp. 1-19 (2010).

* cited by examiner

*Primary Examiner* — Thomas G Black
*Assistant Examiner* — Ce Li Li
(74) *Attorney, Agent, or Firm* — General Electric Company; Sean M. Weinman

(57) ABSTRACT

Systems and methods of refining trajectories for aircraft include a trajectory prediction module for predicting a set of four-dimensional trajectories for aircraft; and a constraint selector module for determining a set of constraints based on the set of four-dimensional trajectories. The trajectory can be refined by mapping values for a goal associated with the set of four-dimensional trajectories based on the determined set of constraints and estimating additional values for the goal based on the mapped values.

16 Claims, 8 Drawing Sheets

SYSTEM AND METHOD OF REFINING TRAJECTORIES FOR AIRCRAFT

BACKGROUND OF THE INVENTION

A typical aircraft flight process begins with the filing of a flight plan by an airline or pilot with a civil aviation authority (e.g. the Federal Aviation Authority in the United States). The flight plan generally outlines the route of a flight and includes origination and destination location and times as well as intermediate routing information that defines an airway or flight path. Airways, though having no physical existence, are akin to three-dimensional highways and can be defined with a set of intermediate waypoints. Waypoints are reference locations in physical space used for purposes of navigation and typically include a latitude, longitude and altitude. While navigating a flight plan, the aircraft flies a trajectory that traverses the set of waypoints in a sequenced order in time. Hence, the flight path actually flown by the aircraft is referred to as a four-dimensional trajectory as the trajectory includes three spatial coordinates and one temporal coordinate.

Based on the origination, destination and intermediate waypoints, a flight management system or trajectory predictor predicts the four-dimensional trajectory to be flown by the aircraft. It is contemplated that modifying a four-dimensional trajectory based on aircraft related factors (i.e. speed, fuel, altitude, turbulence, wind, weather, etc.) and common resource availability (i.e. runways, airspace, air traffic control services, etc.) can improve the efficiency of an aircraft or a fleet of aircraft with respect to one or more business metrics (i.e. fuel conserved, passenger throughput, cost, etc.). However, predicting a four-dimensional trajectory is a computationally expensive problem. Thus, while the flight management system or trajectory predictor accurately predict a four-dimensional trajectory, the prediction is a relatively time consuming operation. Therefore, directly searching for an optimal four-dimensional trajectory among a continuum of possible four-dimensional trajectories for a flight is unlikely to be computationally feasible in a real-time or near real-time environment. The problem is exacerbated when searching for optimal trajectories for a fleet of aircraft.

BRIEF DESCRIPTION OF THE INVENTION

In one aspect, a method of refining a set of four-dimensional trajectories for aircraft includes steps of obtaining data related to the set of four-dimensional trajectories; determining by a constraint selector module a set of constraints for the set of four-dimensional trajectories; mapping in a processor values for a goal associated with the set of four-dimensional trajectories based on the determined set of constraints and estimating in the processor additional values for the goal based on the mapped values. Steps of obtaining, determining, mapping, and estimating are repeated until a value mapped to the goal for a determined final set of constraints exceeds a predetermined threshold. An aircraft trajectory can be predicted based on the determined final set of constraints.

In another aspect, a trajectory refining system includes a trajectory predictor for predicting a set of four-dimensional trajectories for aircraft, a constraint selector module and an update module. The constraint selector module determines a set of constraints for the set of four-dimensional trajectories; maps in a processor values for a goal associated with the set of four-dimensional trajectories based on the determined set of constraints; and estimates additional values for the goal based on the mapped values and repeats the determining, mapping, and estimating steps until a value mapped to the goal for a determined final set of constraints exceeds a predetermined threshold. The update module is coupled to the constraint selector module and the trajectory predictor and configured to obtain data related to a four-dimensional trajectory calculated by the trajectory predictor after every repeating completed by the constraint selector module wherein an aircraft trajectory can be predicted based on the determined final set of constraints.

In another aspect, a method of refining a set of four-dimensional trajectories for aircraft includes the steps of: obtaining from a trajectory predictor, data related to a set of four-dimensional trajectories for aircraft; determining by a constraint selector module a set of constraints for the set of four-dimensional trajectories; mapping in a processor values for a goal associated with the set of four-dimensional trajectories based on the determined set of constraints; setting in the processor estimations of additional values for the goal based on the mapped values; and adjusting the estimations until a value mapped to the goal for a determined final set of constraints exceeds a predetermined threshold. The aircraft trajectory can be predicted based on the determined final set of constraints.

DESCRIPTION OF EMBODIMENTS OF THE INVENTION

Glossary of Terms

The following terms are used throughout the detailed description:

Admissible constraint: An aspect of a candidate trajectory to be executed by an object that includes operational or inherent performance limitations of said object or environment in which said object is traveling.

Four-dimensional trajectory: A time-ordered string of points which describe a path taken by an object between a start point and end point or as a vector in spatio-temporal space that describes, among other aspects, the position of the object.

Perturbation: A slight alteration of one or more aspects of a subset of a set of interacting or interdependent elements.

Set: Any number of elements, including a single element.

Spatio-temporal: Having both spatial and temporal qualities.

At least some of the embodiments of the invention provide for trajectory refining systems, methods and apparatuses for determining a set of constraints so that four-dimensional trajectories flown by aircraft have an improved efficiency with respect to a set of predefined metrics. It will be understood that "a set" can include any number of predefined metrics, including a single predefined metric. Similarly, "a set" as used herein can include any number of elements, including a single element. While conventionally described by a set of three spatial coordinates and one temporal coordinate, it will be understood that "a four-dimensional trajectory" as used herein can be defined as a time-ordered string of points which describe a path taken by an object between a start point and end point or as a vector in spatio-temporal space including the position of the object. Currently, four-dimensional trajectories for aircraft are computed based on factors including but not limited to origin, destination, intermediate waypoints, aircraft performance, weather conditions and separation constraints. In response to varying constraints or targets or combinations thereof, a trajectory prediction system determines a four-dimensional trajectory and, given the response time requirements, does not fully exploit all the available information that can be relevant for meeting strategic goals related to fleet optimization or on-board flight management system optimization. More specifically, in most on-line applications, the trajectory prediction system does not have the computational time required to determine a four-dimensional trajectory that considers separation constraints, weather conditions and performance optimal maneuvers such as minimum fuel/cost cruising altitude and fuel/cost optimal path stretching.

Figure 1:
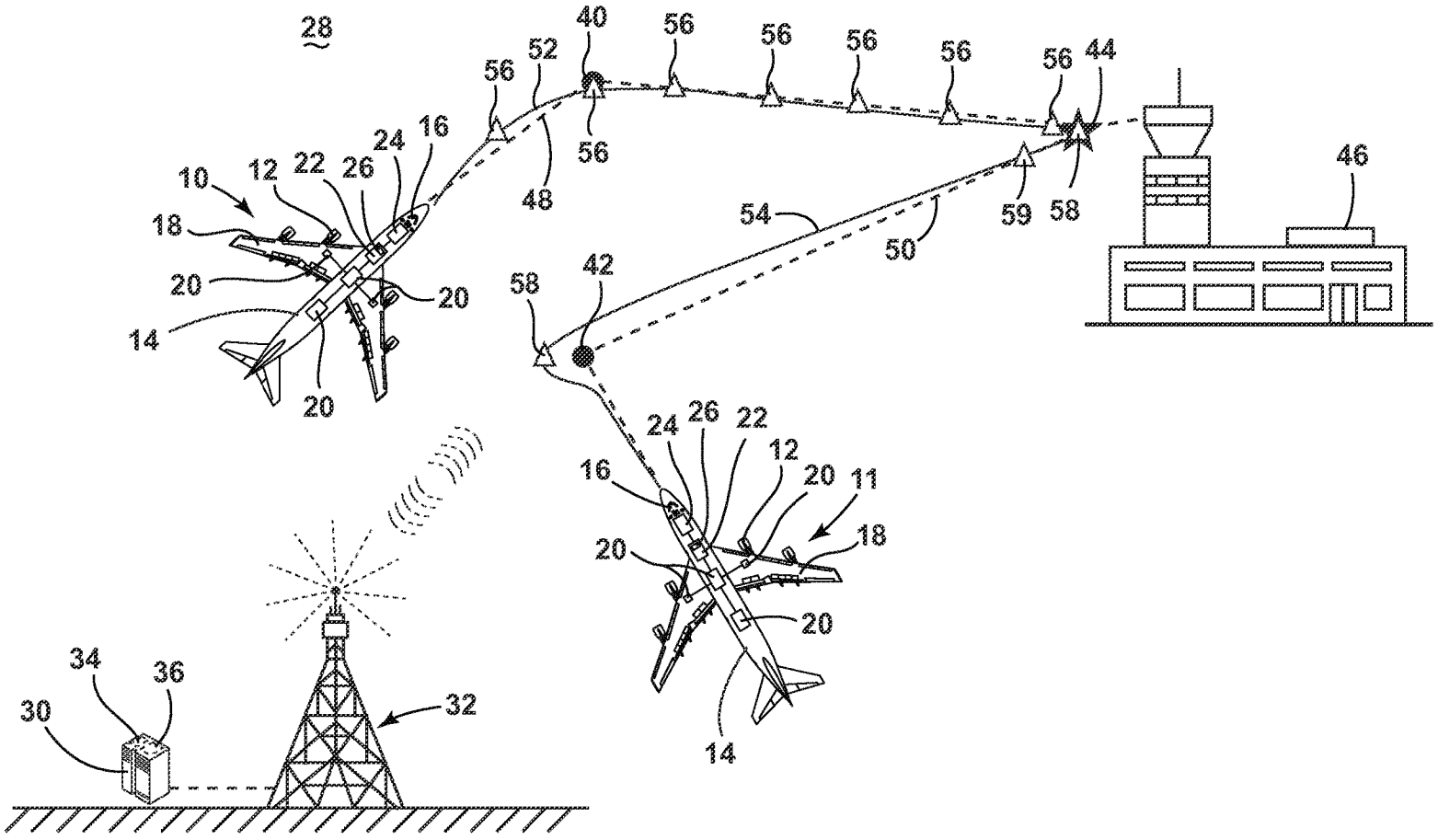
FIG. 1 is an example schematic illustration of aircraft with trajectories and a ground system in accordance with various aspects described herein.

FIG. 1 depicts a processor 36 in communication with a ground station 32 communicating with aircraft 10, 11 in accordance with various aspects described herein. The aircraft 10, 11 can fly a route from one location to another, and can include elements common to aircraft such as one or more propulsion engines 12 coupled to a fuselage 14. Other common aircraft elements include a cockpit 16 positioned in a fuselage 14 and wing assemblies 18 extending outwardly from the fuselage 14. Further, a set of aircraft systems 20 that enable proper operation of the aircraft 10, 11 can be included as well as a controller or computer 22, and a communication system having a communication link 24. Such aircraft systems 20 can include but are not limited to an electrical system, an oxygen system, hydraulics or pneumatics system, a fuel system, a propulsion system, a flight management system, flight controls, audio/video systems, an Integrated Vehicle Health Management system, and systems associated with the mechanical structure of the aircraft 10, 11. While a commercial aircraft has been illustrated, it is contemplated that embodiments of the invention can be used in any type of aircraft, for example, without limitation, fixed-wing, rotating-wing, rocket, personal aircraft, autonomous pilotless aircraft and military aircraft.

The computer 22 can be operably coupled to the set of aircraft systems 20 and it is contemplated that the computer 22 can aid in operating the set of aircraft systems 20 and can receive information from the set of aircraft systems 20. The computer 22 can, among other things, automate the tasks of piloting and tracking the flight plan of the aircraft 10, 11. The computer 22 can also be connected with other controllers or computers of the aircraft 10, 11.

The computer 22 can include memory 26, the memory 26 can include random access memory (RAM), read-only memory (ROM), flash memory, or one or more different types of portable electronic memory, such as discs, DVDs, CD-ROMs, etc., or any suitable combination of these types of memory. The computer 22 can include one or more processors, which can be running any suitable programs. It will be understood that the computer 22 can include or be associated with any suitable number of individual microprocessors, power supplies, storage devices, interface cards, auto flight systems, flight management computers, and other standard components and that the computer 22 can include or cooperate with any number of software programs (e.g., flight management programs) or instructions designed to carry out the various methods, process tasks, calculations, and control/display functions necessary for operation of the aircraft 10, 11.

The communication link 24 can be communicably coupled to the computer 22 or other processors of the aircraft to transfer information to and from the aircraft 10, 11. It is contemplated that the communication link 24 can be a wireless communication link and can be any variety of communication mechanism capable of wirelessly linking with other systems and devices and can include, but is not limited to, packet radio, satellite uplink, SATCOM internet, air-ground internet services, VDL, ACARS network, Wireless Fidelity (WiFi), WiMax, Bluetooth, ZigBee, 3G wireless signal, code division multiple access (CDMA) wireless signal, global system for mobile communication (GSM), 4G wireless signal, long term evolution (LTE) signal, Ethernet, or any combinations thereof. It will also be understood that the particular type or mode of wireless communication is not critical to embodiments of this invention, and later-developed wireless networks are certainly contemplated as within the scope of embodiments of this invention. Further, the communication link 24 can be communicably coupled with the computer 22 through a wired link without changing the scope of embodiments of this invention. Although only one communication link 24 has been illustrated, it is contemplated that the aircraft 10, 11 can have multiple communication links communicably coupled with the computer 22. Such multiple communication links can provide the aircraft 10 with the ability to transfer information to or from the aircraft 10 in a variety of ways.

As illustrated, the computer 22 of the aircraft 10, 11 can communicate with a remote server 30, which can be located anywhere, such as at a designated ground station 32 via the communication link 24. The ground station 32 can be any type of communicating ground station 32 including, but not limited to, an air-traffic control or airport operations control center. The remote server 30 can include a computer searchable database of information 34 accessible by the processor 36. The processor 36 can run a set of executable instructions to access the computer searchable database of information 34. The remote server 30 might include a general-purpose computing device in the form of a computer, including a processing unit, a system memory, and a system bus, that couples various system components including the system memory to the processing unit. The system memory can include read only memory (ROM) and random access memory (RAM). The computer can also include a magnetic hard disk drive for reading from and writing to a magnetic hard disk, a magnetic disk drive for reading from or writing to a removable magnetic disk, and an optical disk drive for reading from or writing to a removable optical disk such as a CD-ROM or other optical media. It will be understood that the computer searchable database of information 34 can be any suitable database, including a single database having multiple sets of data, multiple discrete databases linked together, or even a simple table of data. It is contemplated that the computer searchable database of information 34 can incorporate a number of databases or that the database can actually be a number of separate databases.

During operation of the aircraft 10, 11, the computer 22 can request or receive information from the remote server 30. In this manner, the computer 22 can form a portion of a system for refining a trajectory for aircraft 10, 11. Alternatively or additionally, the system for refining the trajectory for aircraft 10, 11 can include the computer 22 which can form a portion of the flight management system. Alternatively or additionally, the memory can include a database component. It will be understood that the database component can be any suitable database, including a single database having multiple sets of data, multiple discrete databases linked together, or even a simple table of data. It is contemplated that the database component can incorporate a number of databases or that the database can actually be a number of separate databases. The database component can contain information including, but not limited to, airports, runways, airways, waypoints, navigational aids, airline/company-specific routes, and procedures such as standard instrument departure (SID), standard terminal approach routes (STAR), and approaches.

Each aircraft 10, 11 can fly a route described initially by a flight plan than can include a set of waypoints. For example, an aircraft 10 can fly a route initially described by a flight plan that includes intermediate waypoints 40, 44 and destination waypoint 46 (illustrated as an airport). In another example, an aircraft 11 can fly a route initially described by a flight plan that includes intermediate waypoints 42, 44 and destination waypoint 46. The waypoints serve as navigational markers but not as complete descriptions of the intended trajectory as aircraft do not instantly correct course from one straight-line segment to the next as shown in straight-line routes 48, 50. Instead, a system, such as the flight management system or other trajectory predictor system, determines a four-dimensional trajectory 52, 54 that aircraft can safely fly and pass near each waypoint at approximately the scheduled time for said waypoint.

An update module (shown in FIG. 5 as 314 and FIG. 6 as 414) of the trajectory refining system 28, included in computer 22 or remote server 30 can obtain data related to the constraints or targets pertaining to the set of four-dimensional trajectories 52, 54. The data can be information related to any aspect of the predicted route to be flown by the aircraft including, but not limited to, latitude, longitude, time, aircraft weight, rate of fuel burn, vertical speed, ground speed, airspeed, temperature, turbulence, wind and combinations thereof.

A constraint selector module (shown in FIG. 5 as 316 and FIG. 6 as 416) of the trajectory refining system 28 included in computer 22 or remote server 30 can determine a set of constraints 56, 58 based on the obtained data. In this way, the set of constraints 56, 58 represent a set of constraints or targets that a generated four dimensional trajectory should consider, take into account, or otherwise be based on. Each constraint is a vector describing a single point along the four-dimensional trajectory. The constraint can include a set of values related to any aspect of the four-dimensional trajectory at the representative point, including, but not limited to, altitude, latitude, longitude, expected time of arrival and point sequence. The constraint selector module can select the constraints that make up the set of constraints based on any initial rule, strategy or criterion including, but not limited to, the distance between the constraints, expected time of arrival of the aircraft to the locations defined by the constraints, etc. For example, the constraint selector module can evenly space the set of constraints 56 with respect to the distance along the trajectory 52 for the aircraft 10. In another example, the constraint selector module can place the set of constraints 58 in proximity to the intermediate waypoints 42, 44 and the destination waypoint 46 for the aircraft 11.

The constraint selector module (shown in FIG. 5 as 316 and FIG. 6 as 416) manages the definition and selection of problem specific constraints. For example, if a goal of the trajectory refining system is to determine the best lateral path to meet some predefined cost objective, the constraint selector module can divide the original four-dimensional trajectory into numerous constraints 56. Initially, the constraints are chosen from the spatio-temporal vector that defines the trajectory to be modified, hence the constraints initially meet this four-dimensional trajectory. After selecting the initial set of constraints by logic determined by the above-defined goal, the constraint selector module defines a finite set that contains the selected constraints, 56. In optimal control, this set is conventionally referred to as the set of admissible controls. The constraint selector module defines the set of admissible constraints; a set of constraints that limits the search to the set of trajectories that adhere to these constraints as well as the inherent performance constraints of the aircraft captured in the trajectory predictor.

Figure 2:
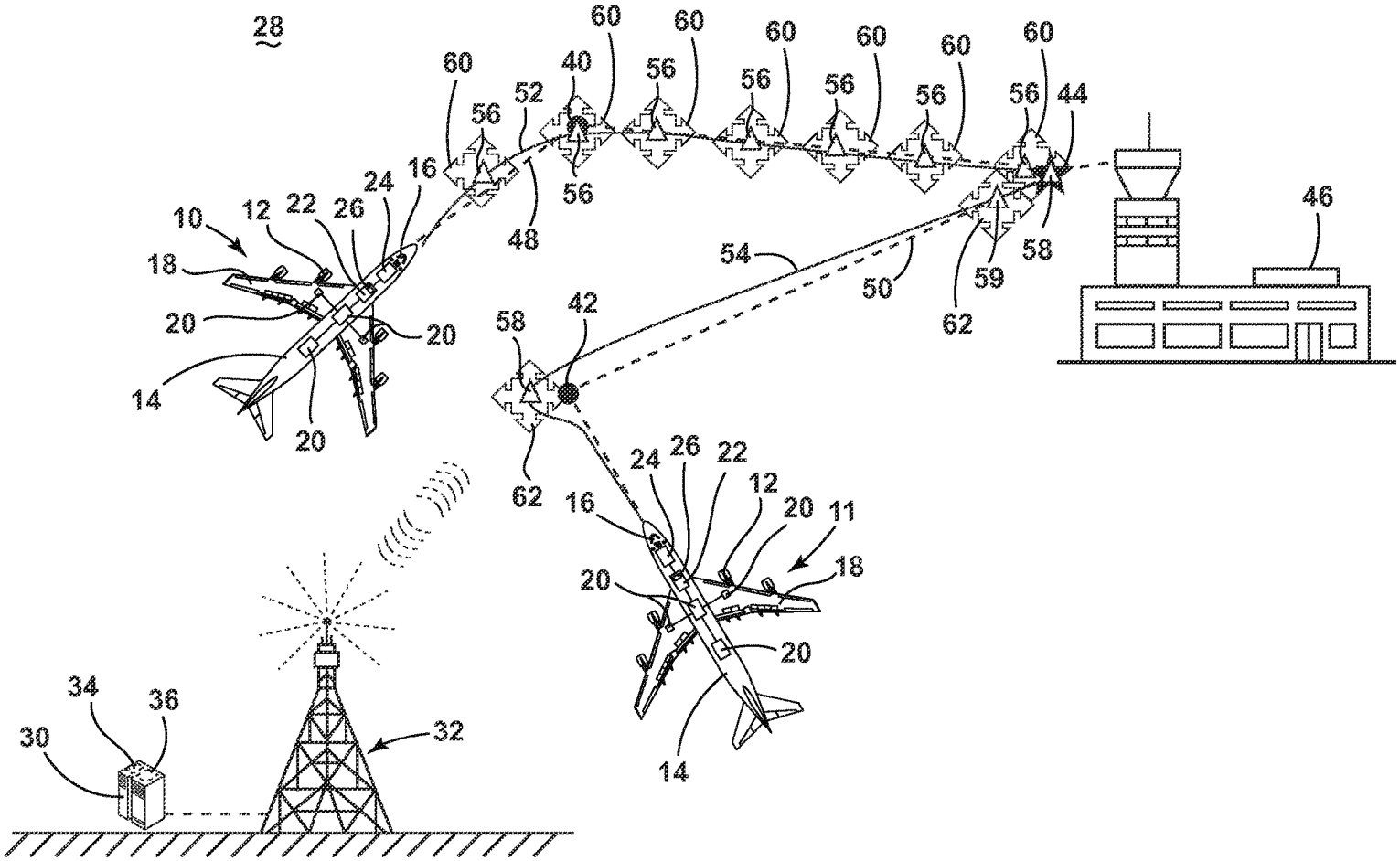
FIG. 2 is an example schematic illustration of aircraft with trajectories and a set of constraints and a ground system in accordance with various aspects described herein.

FIG. 2 depicts a processor 36 in communication with a ground station 32 communicating a refined set of constraints to aircraft 10, 11 in accordance with various aspects described herein. The constraint selector module evaluates the set of constraints 56, 58 and based on the evaluation, selects a new set of constraints, by perturbing the set of constraints 56, 58 within the set of admissible constraints. The constraint selector module selects a perturbation 60, 62 that alters the set of aspects described by each constraint. The perturbation can alter any aspect of the constraint vector, including, but not limited to, the latitude, longitude and time requirement of each constraint 56, 58 as shown in FIG. 2 and discussed in more detail herein.

Figure 3:
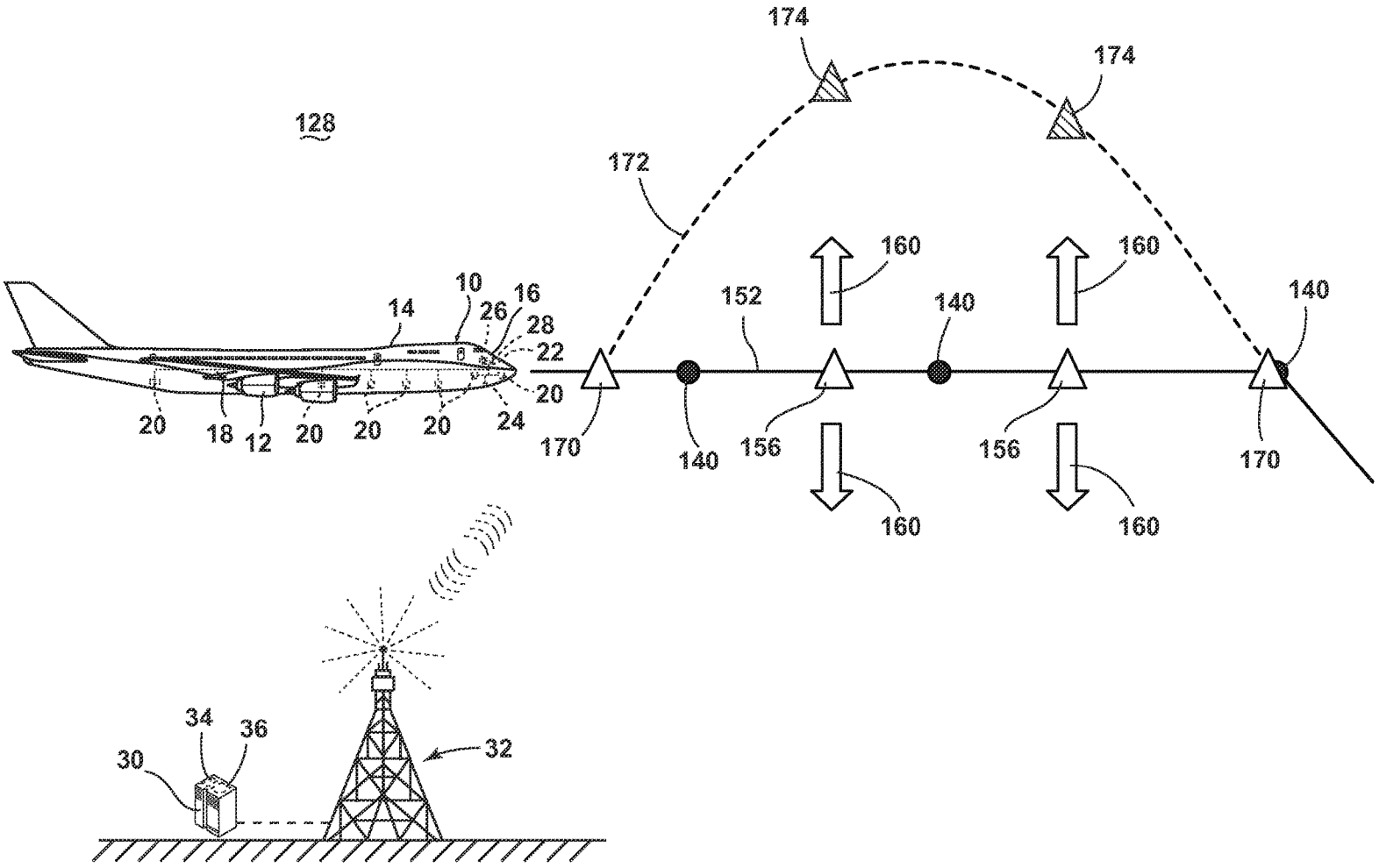
FIG. 3 is an example schematic illustration of aircraft with trajectories and a refined set of constraints for efficient cruising and ground system in accordance with various aspects described herein.

Illustrating an embodiment of the trajectory refining system 128 for improving a cruising trajectory, FIG. 3 depicts an example where the perturbation 160 can alter the altitude constraints 156. Cruising flight is a generally level portion of aircraft travel where most of the flight time is spent. For this reason it is a prime candidate for cost and fuel optimization. Aircraft tend to operate more fuel efficiently at higher altitudes; however, the capable altitudes of aircraft are dependent on weight. As aircraft burn fuel, their weight changes and it becomes more fuel efficient to climb or drift up to take advantage of atmospheric conditions for improved fuel efficiency. The described climb or drift-up is complicated by factors including but not limited to atmospheric conditions the aircraft operates in, alternate strategic goals by the operator such as time performance, other air traffic and separation minima and constraints imposed by air navigation service providers. While the trajectory refining system 128 can compute the optimal drift up with the objective of minimizing total fuel to beginning of descent 170, the trajectory refining system 128 can refine the original trajectory 152 to compensate for additional business and logistical objectives and output a refined trajectory 175. Additional business and logistical objectives can be any objective related to the operation of the aircraft and can include but not be limited to, decreasing fuel consumption, coordinating time-of-arrival across multiple aircraft in a fleet, minimizing passenger misconnections, minimizing operator cost, etc.

The aircraft 10, during the cruising section of a route, can fly a level altitude as is predicted by the trajectory prediction module (shown in FIG. 5 as 312 and FIG. 6 as 412), based in part, by intermediate waypoints 140 which share a common altitude. The constraint selector module can determine a set of constraints 170, 156 that are equally spaced along the trajectory 152. The constraint selector module can perturb a subset of the constraints 174 up or down in altitude to determine a final set of determined constraints 170, 174. The trajectory prediction module then determines a refined trajectory 172 based on the final set of determined constraints 174. In this way, the final trajectory the aircraft 10 flies is refined in altitude only in the cruising portion of the flight.

Described in FIG. 3, the constraint selector module selects a number of altitudes that initially adhere to the trajectory to be refined and constructs a set of admissible altitude constraints that encompass the initial trajectory's altitude constraints, 156 in accordance with various aspects described herein. For example, to meet altitude separation standards in the United States, the admissible constraint set could contain discrete altitude values encompassing the initial altitude and values at 2000 foot intervals from that altitude up to the maximum altitude for the aircraft in consideration and down to a minimum altitude.

Figure 4:
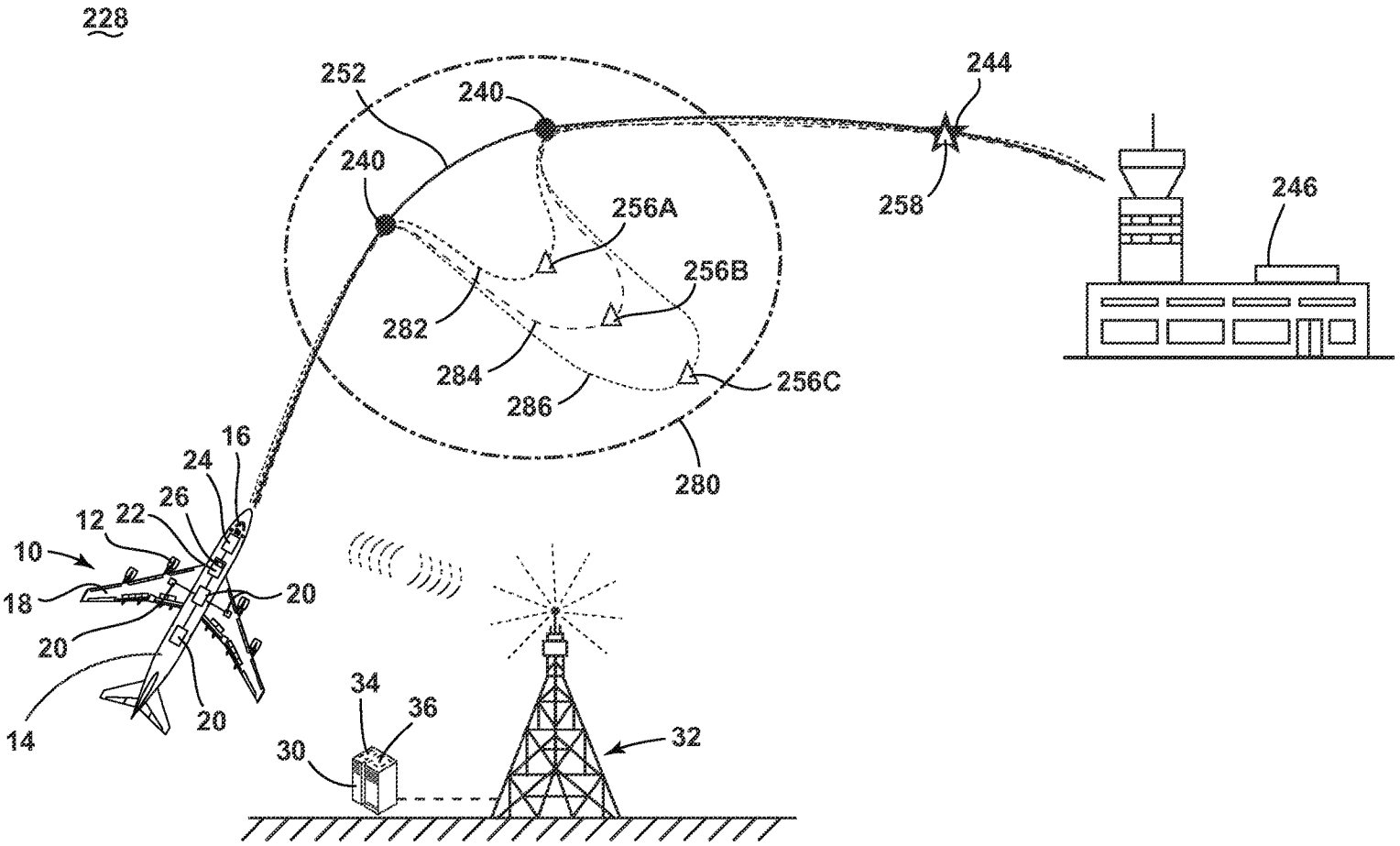
FIG. 4 is an example schematic illustration of aircraft with trajectories and a refined set of constraints for path stretching and ground system in accordance with various aspects described herein.

FIG. 4 depicts an example of the trajectory refining system 228 for implementing a path stretch maneuver where a route is altered to extend the required time-of-arrival from a scheduled time to a later time while meeting an operator-defined objective in accordance with various aspects described herein. To accomplish a path-stretch maneuver, an aircraft deviates from the nominal flight path and alters airspeed to increase the overall path length of the flight. A path-stretch maneuver can be used to better perform trajectory routing and management thereof with considerations that can include, but not be limited to, sector traffic, weather, emissions, fuel burn or airline costs.

To perform a path-stretching maneuver, the aircraft 10 during the route can fly in a spatially-defined region 280 amenable to path deviations for the purpose of extending a time-of-arrival to a final waypoint 244 for arrival to destination 246. Along with the lateral deviation from the altered path length of the trajectory, the aircraft speed is altered in order to minimize an objective relating, but not limited to fuel or cost minimization. The unstretched portion of the trajectory 252, as is predicted by the trajectory prediction module, is based, in part, by intermediate waypoints 240. The constraint selector module can determine a set of constraints 256 that are temporally intermediate to the intermediate waypoints 240, along with a constraint 258 that is spatially confined to the final waypoint 244 but temporally dynamic. The constraint selector module perturbs the set of constraints 256 spatially according to a time constraint to be applied to effect a specific time-of-arrival enforced at constraint 258. That is, the constraint selector module determines the position of the set of constraints 256 such that the time associated with the final constraint 258 meets a desired, delayed time-of-arrival.

As shown in FIG. 4, the constraint selector module can determine the constraints 256 in the spatially-defined region 280 to be one of many possible sets of constraints 256A, 256B, and 256C. Each set of constraints 256A, 256B, 256C will result in a respective trajectory 282, 284, 286 calculated by the trajectory prediction module where each trajectory 282, 284, 286 will uniquely extend the time-of-arrival of the aircraft 10 to the final waypoint 244 as encoded in the final constraint 258. The trajectory prediction module determines a refined trajectory based on the final set of determined constraints that corresponds with the path-stretch maneuver with the desired extension in time-of-arrival to the destination 246.

Figure 5:
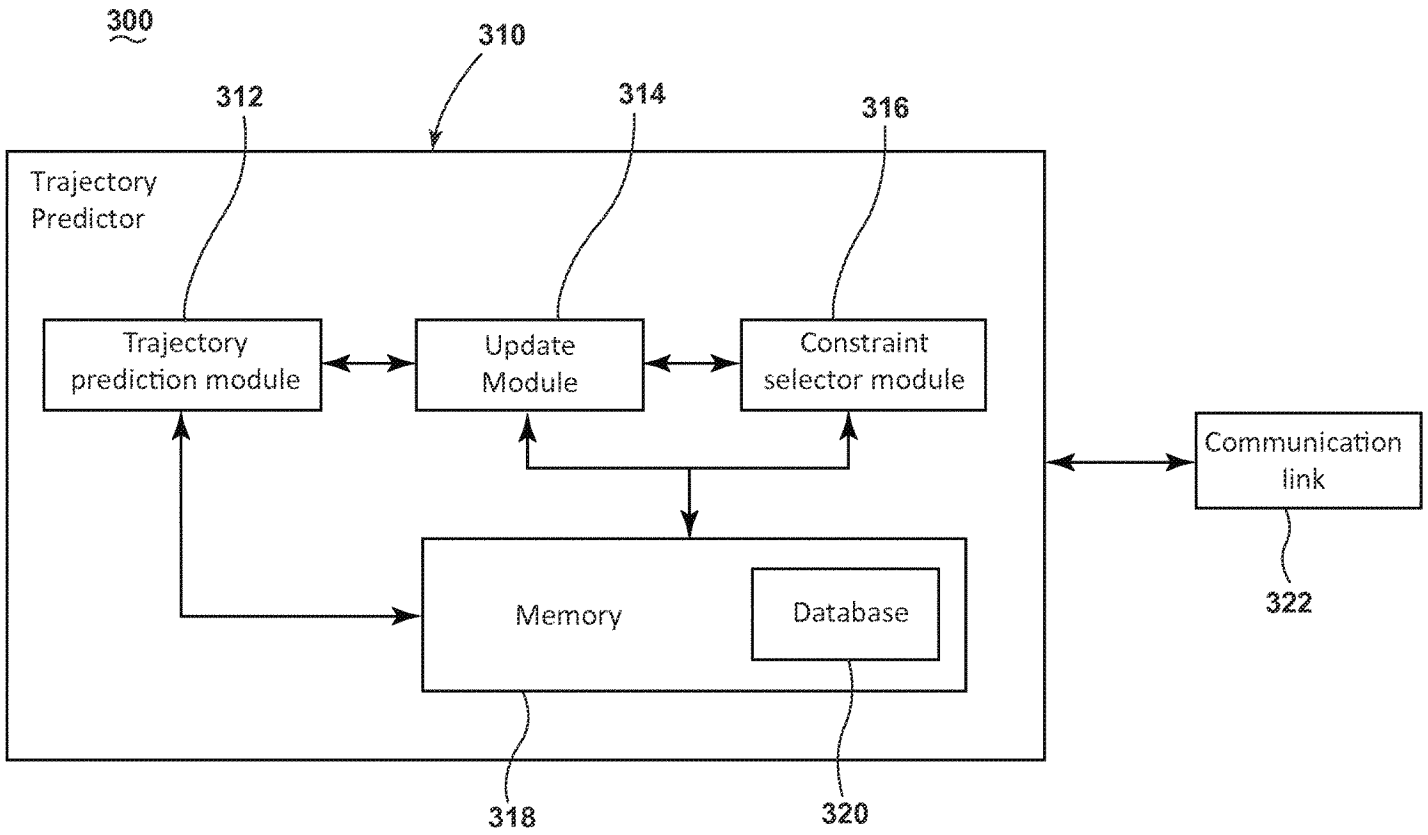
FIG. 5 an example block diagram of a trajectory predictor system in accordance with various aspects described herein.

Referring now to FIG. 5, an example block diagram of a trajectory refining system 300 for use in predicting trajectories in accordance with various aspects described herein is shown. The trajectory refining system 300 includes a trajectory predictor 310 and communication link 322. The trajectory predictor 310 includes an update module 314 communicatively coupled to a constraint selector module 316 and a trajectory prediction module 312. A memory module 318 including a database submodule 320 is in communication with the trajectory prediction module 312, the update module 314 and the constraint selector module 316. As shown, the trajectory predictor 310 includes the update module 314, the constraint selector module 316 and the memory module 318 along with the trajectory prediction module 312. The trajectory predictor 310 can be located on an aircraft (e.g. as part of a flight management system) and in communication with one or more ground stations via communication link 322. The components of the trajectory predictor 310 can be collocated on the aircraft or placed in various locations around the aircraft depending upon the implementation. The update module 314, the constraint selector module 316 and the trajectory prediction module 312 can include any suitable combination of software and hardware elements necessary for the operation of the trajectory refining system 300, including but not limited to, application-specific integrated circuits, flash memory, random access memory, field-programmable gate arrays and combinations thereof including bespoke and industry standard software configured on said devices for performing the functional requirements associated with implementations of said modules.

Figure 6:
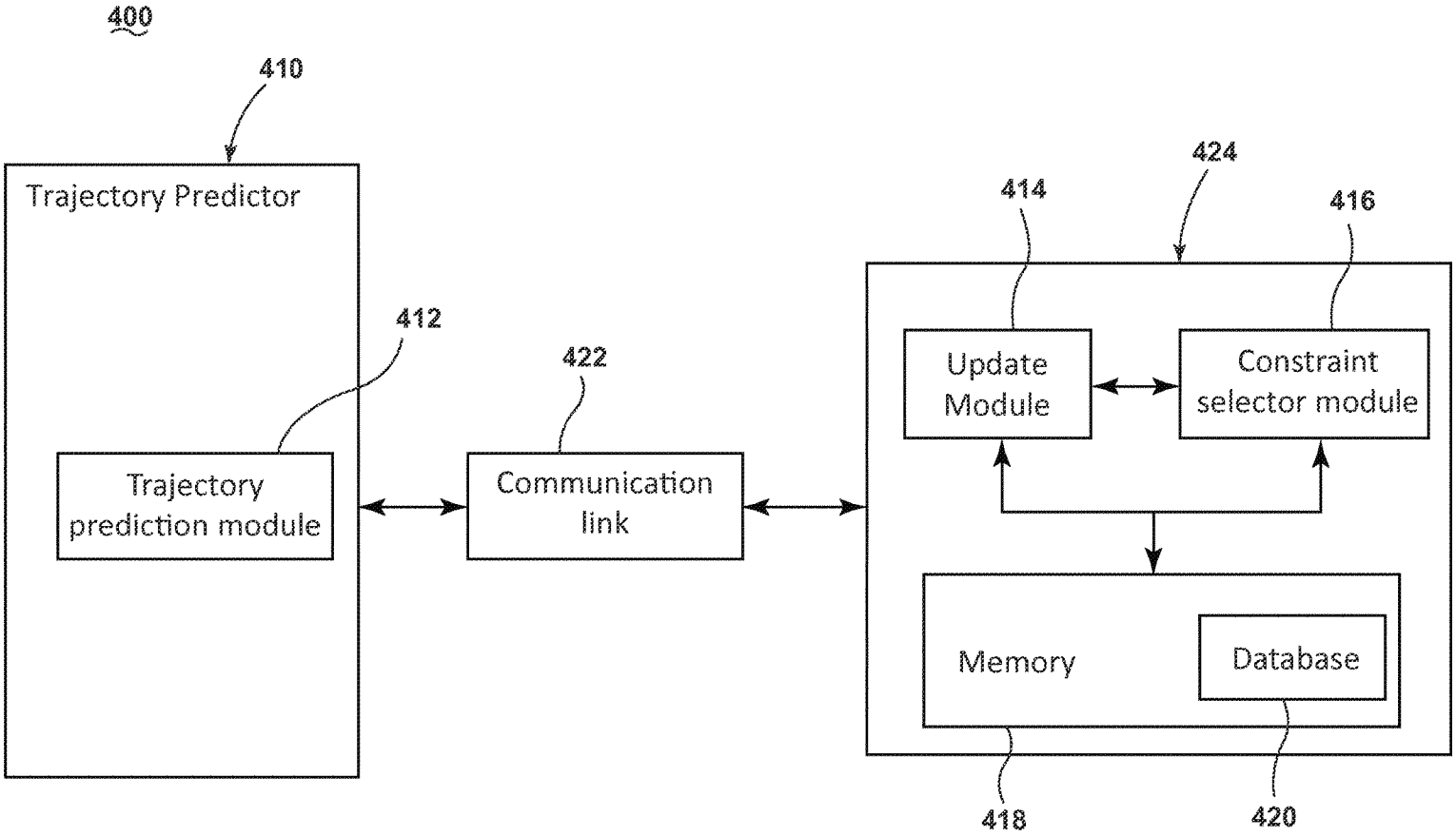
FIG. 6 is an example block diagram of a trajectory predictor in accordance with various aspects described herein.

Referring now to FIG. 6, an example block diagram of a trajectory refining system 400 for use in predicting trajectories in accordance with various aspects described herein is shown. The trajectory refining system is similar to that illustrated in FIG. 5; therefore, like parts will be identified with like numerals increased by 100, with it being understood that the description of the like parts of the first trajectory refining system applies to the second trajectory refining system, unless otherwise noted. The trajectory refining system 400 includes a trajectory predictor 410 having a trajectory prediction module 412. The trajectory prediction module 412 is in communication via communication link 422 with a remote refinement component 424, physically separate from the flight management system 410. In this way, the trajectory refining system 400 can include a legacy flight management system 410. The remote refinement component 424 can be part of a remote server maintained, for example, at an air-traffic control or airport operations control center.

Figure 7:
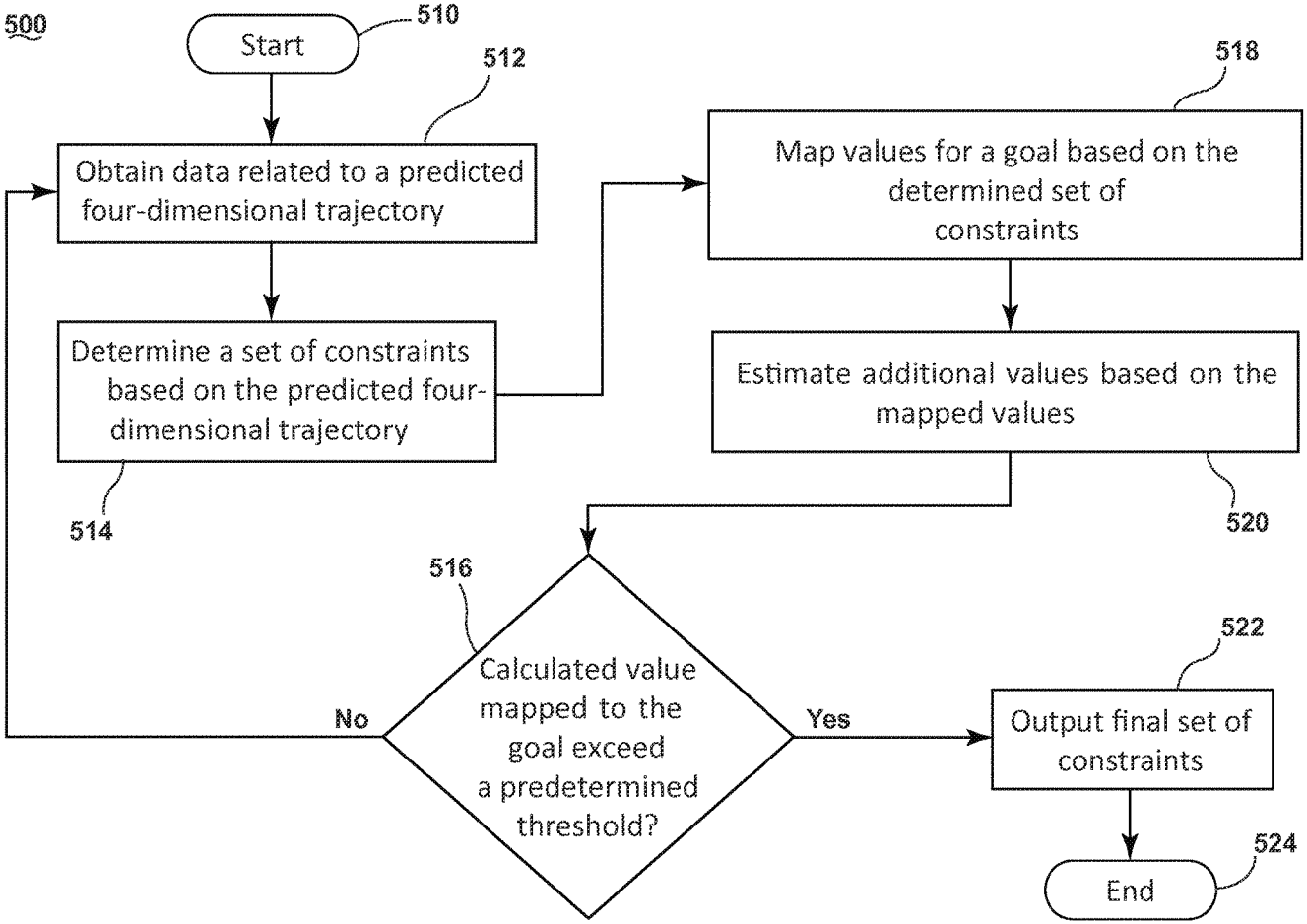
FIG. 7 is a flowchart illustrating a method of refining trajectories for aircraft in accordance with various aspects described herein.

FIG. 7 is a flowchart showing a method 500 of refining trajectories for aircraft in accordance with various aspects discussed herein. Starting at step 510, data related to a heretofore unexecuted flight plan or an aircraft enroute is available to the trajectory refining system. The update module obtains data related to a set of four-dimensional trajectories at step 512. The data can relate to any aspect of the four-dimensional trajectory including, but not limited to, altitude, latitude, longitude, expected time of arrival, sequence, wind speed, temperature, airspeed, ground speed, or combinations thereof such as provided in waypoints. The constraint selector module, at step 514, determines a set of admissible constraints that bound the set of admissible four-dimensional trajectories that could satisfy the problem. Like the data obtained by the update module, the set of constraints can include any aspect of the four-dimensional trajectory, including, but not limited to, altitude, latitude, longitude, expected time of arrival, sequence where sequence is included for the case when the same spatial coordinate is visited multiple times and the arrival time is unspecified, etc.

At step 518, the constraint selector module 316, 416 maps values for a goal associated with the set of four-dimensional trajectories based on the determined set of constraints. The goal can be related to any business or logistical goal, fleet optimization or on-board flight management optimization including but not limited to patch-stretch maneuvers, optimum cruise profiles, coordinated time-of-arrival, fuel consumption, cost of fuel, time-of-arrival, flight duration, inclement weather avoidance, etc. The constraint selector module can map the set of constraints to a metric indicative of the goal using any kind of mapping that translates a four-dimensional trajectory into a value that correlates to the level of attainment of a goal including but not limited to implementing an objective function. By determining an objective function, the constraint selector module 316, 416 maps the relationship between the values of the set of the trajectories defined by the set of admissible constraints to a real number that represents a cost or goal associated with the four dimensional trajectories. For example, flying an aircraft according to the trajectories associated with the sets of constraints from FIG. 2 will result in some expenditure of fuel. Perturbing the set of constraints within the set of admissible constraints to alter the trajectories will result in a different expenditure of fuel. The constraint selector module 316, 416 maps the set of constraints to a value indicative of the expenditure of fuel (e.g., cost). In another example, flying an aircraft according to a trajectory determined by the altitude profile indicated in FIG. 3 will also result in some expenditure of fuel. Perturbing the set of constraints to alter the altitude profile will result in a different expenditure of fuel. In yet another example, flying an aircraft according to a path-stretch maneuver determined by the trajectory indicated in FIG. 4 will result in some extension in the time-of-arrival to the flight destination. Constraining the path-stretch maneuver to a defined time constraint 258 results in the aircraft flying differing speed profiles along each extended lateral path to the destination. Thus perturbing the lateral path length 252 by inserting trial a sets of constraints 256A-C to alter the trajectory from 252 to 282, 284 and 286 while maintaining the time requirement 258 will result in different fuel expenditures between from intermediate waypoints 240 and final waypoint 244.

In one instance, the constraint selector module 316, 416 iteratively maps the set of constraints to a goal by building the objective function from observations of a select number of constraints from the admissible set at step 518, evaluating the objective function for resulting trajectories and predicting unobserved objective function values using the observed trajectory-objective-value pairs at step 520. As the method 500 is iterative, previously calculated values for previously determined sets of constraints are prior information used, in part, when estimating the objective function.

The constraint selector module 316, 416 determines if the calculated value mapped to the goal exceeds a predetermined threshold at step 516. For example, if the constraint selector module 316, 416 maps values for a goal based on the set of constraints using an objective function, then the predetermined threshold can include calculating a value of the objective function for the current set of constraints that exceeds a predetermined threshold. The predetermined threshold is any limit that effectively completes the iterative process including, but not limited to, a limit on computational budget (e.g. a total amount of time or number of computing cycles to be spent computing a refined trajectory for the given computational hardware), convergence to an extremum of an objective function, and exceeding a predetermined value of the objective function. If the calculated value for the objective function does not exceed a predetermined threshold for the current set of observed constraints, the constraint selector module determines a new set of constraints at step 514 to observe based on the current estimate of the objective function. The constraint selector module can determine the next set of constraints by any process that decreases uncertainty in the estimate of the objective function. For example, the constraint selector module can select the next set of constraints to evaluate based, in part, on the objective function's estimated mean and uncertainty. As part of the iterative process observed from steps 516 back to step 512, the constraint selector module communicates with the trajectory prediction module via the update module to transfer data related to the set of constraints and refined four-dimensional trajectories. That is, with each iteration where the constraint selector module determines a next set of constraints, the update module transfers the four-dimensional trajectory data to the trajectory prediction module which calculates a refined trajectory. The refined trajectory is then transmitted back to the constraint selector module via the updated module for using in determining the next set of constraints.

Upon determining that a calculated value for the objective function exceeds a predetermined threshold, the update module outputs the final set of determined constraints to the trajectory prediction module at step 522. Finally, at step 524, the trajectory prediction module can determine the refined trajectory based on the final set of constraints.

Figure 8:
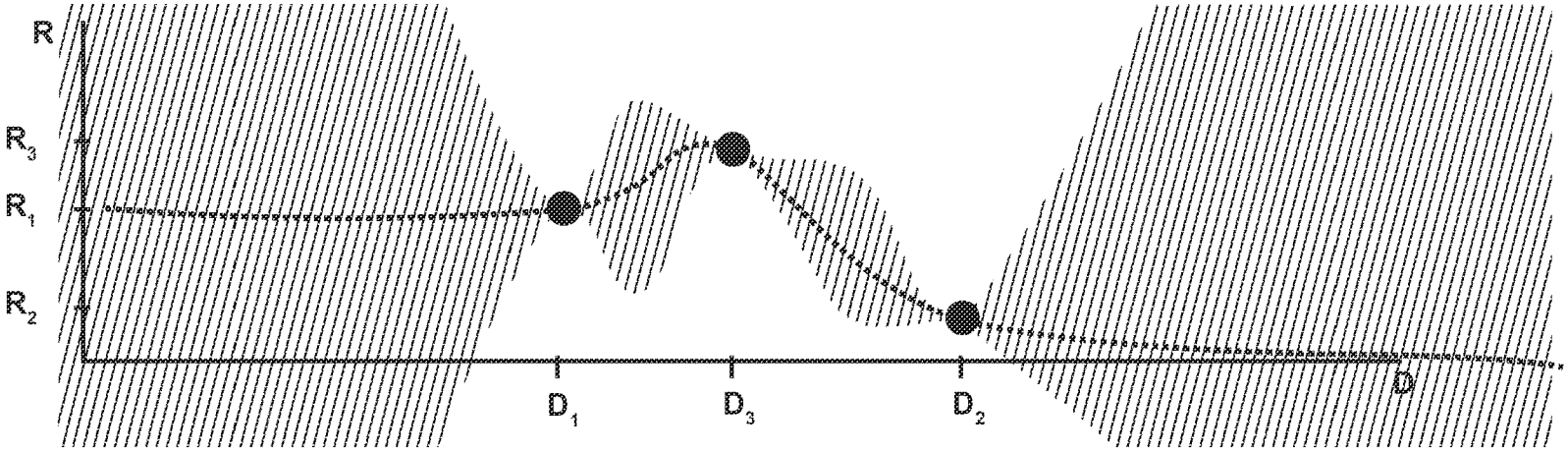
FIG. 8 is a plot illustrating an iterative process to converge to a set of constraints that refines trajectories for aircraft in accordance with various aspects described herein.

For purposes of illustrating the iterative process that the trajectory refining system can incorporate, FIG. 8 is a plot depicting the relationship between sets of constraints and an estimated objective function. In this way, FIG. 8 depicts an iterative process to converge to a set of constraints that refines trajectories for aircraft via a method such as illustrated in FIG. 7. In FIG. 8, a partially known objective function is shown in dotted line. The objective function is observed at D1, D2 and D3 by computation of four-dimensional trajectories adhering to D1, D2 and D3 along with the aircraft performance captured in a performance database and the airspace weather as captured in the trajectory predictor's weather model and evaluation of the objective function based on those trajectories to determine values R1, R2 and R3. The unobserved, or unevaluated, portion of the objective function is then calculated or approximated using a measure of the correlation between the observed and, thus far, unobserved objective value pairs. The goal of any optimization procedure is to find the global extremum values (i.e. minima or maxima) of the objective function of interest in minimum time; in other words, the goal is to quickly converge to the maximum (i.e. benefit) or minimum (i.e. cost) value of the function. As shown in FIG. 8, the goal of the optimization procedure is attained by repeated observation of objective function value pairs, prediction of unobserved values and selection of new constraints for evaluation until convergence to an approximate extrema or the attainment of a time goal from the system to return a solution consisting of a set of constraints.

As described above, the method is iterative, and therefore the constraint selector module determines a first set of constraints D1 and then evaluates D1 to determine R1. Then, with the additional knowledge of the (D1, R1) pair, the constraint selector module determines a second set of constraints D2 and then evaluates D2 to determine R2. Then, with the additional knowledge of both the (D1, R1) pair and the (D2, R2) pair, the constraint selector module determines a third set of constraints D3 and then evaluates D3 to determine R3. If R3 does not exceed a predetermined threshold, the iterative method continues, otherwise the update module outputs the set of constraints D3 as the constraint that describes the refined trajectory.

In the example shown and more generally to the formulation of the optimization problem solved in part by the constraint selector module, the constraint selector module estimates the objective function and does so to increase the fidelity of the estimate as additional set of constraints, D, are evaluated. As the constraint selector module searches for an extremum of the objective function, each evaluation of a (D,R) pair increases knowledge and decreases uncertainty in the estimate of the objective function. In other words, based on what is known from D1, D2 and D3 in the example shown in FIG. 8, an extremum in the form of a maximum in the objective function emerges to the left of D3. The hatched surface overlaying the dotted representation of the objective function represents the variance or uncertainty in the estimate of the objective function after the three iterations (D1, R1), (D2, R2), and (D3, R3). Initially, the uncertainty estimate would have been much wider and each iteration collapses the uncertainty around an evaluated (D, R) pair and also in a neighborhood around D. As shown in the example in FIG. 8, the constraint selector module can choose a next set of constraints just left of D3 and evaluate for R. Repeating this strategy is likely to lead the constraint selector module to converge to that maximum for the objective function.

As is evidenced by the wide uncertainties to the left of D1 and right of D2, the strategy might not necessarily discover the global extremum. Because the objective function is unknown to the constraint selector module, a more optimal set of constraints out beyond either D1 or D2 cannot be ruled out without evaluating sets of constraints D out in those regions. When the constraint selector module determines a set of constraints, D and evaluates the value of R, the uncertainty around that (D,R) pair collapses such that at the current set of constraints D, the constraint selector module has precise knowledge of R and is more certain of the value of R for points near the evaluated D which represent sets of constraints that are similar to the current set of constraints. Therefore, the constraint selector module can choose a next set of constraints D where the uncertainty is greatest to increase knowledge of the objective function.

Therefore, the constraint selector module determines the next set of constraints D based on two underlying objectives: exploiting the available information of the objective function to find an extremum that satisfies a predetermined threshold or exploring regions of highest uncertainty. The constraint selector module can balance these objectives using any strategy devised to determine both an extremum value of an unknown objective function and decrease uncertainty in an estimate of an unknown objective function including but not limited to the three strategies presented below.

The constraint selector module can select the next set of constraints D to evaluate based on a random draw, a so-called "coin-flip" strategy. Initially, the constraint selector module can bias the random draw towards selecting sets of constraints in areas of highest uncertainty. As the constraint selector module gains knowledge of the objective function (e.g. as the number of evaluations increases), the constraint selector module can bias the random draw towards sets of constraints nearest to predicted extremum of the objective function. Alternatively, the constraint selector module can set the number of iterations for selecting sets of constraints in areas of highest uncertainty followed by a set number of iterations for selecting sets of constraints nearest to predicted extremum of the objective function. Alternatively, the constraint selector module can select sets of constraints in areas of highest uncertainty until a set of constraints where the evaluated value of the objective function exceeds a predetermined threshold.

In real-world operations, certain operational requirements and limits define the superset of constraints that are realizable. The operational requirements and limits can be any requirements and limits known to limit the achievable sets of constraints and include, but are not limited to, the physical limits of the aircraft, the standards and operating practices for air traffic, etc. In this way, the uncertainty out at the edges of the x-axis D will be decreased as the constraint selector module has implicit knowledge that these sets of constraints will not result in a desirable value for the objective function.

The above-described method and the constraint selector module can use any algorithms and strategies useful for iterative optimization including, but not limited to approximating optimal trajectories of aircraft by computing an optimal constraint vector using a problem-specific allowable set of four-dimensional trajectory constraints along with implicit aircraft performance and weather constraints captured in the trajectory prediction module by employing a Bayesian Optimization (BO) method. In this implementation, the constraint selector module constructs a set of problem-specific admissible constraints, such as the admissible altitude constraints 156 along the cruise trajectory 152 of an aircraft as described in the optimum cruise profile problem pictured in FIG. 3. With the goal of selecting the optimal constraint from the admissible set that results in convergence to the global maxima or minima of the objective function without the need for evaluating the objective function at each admissible constraint, the method forms a jointly Gaussian distribution over the set of observed objective function values R(s) in FIG. 8 and unobserved objective function values. Using a model describing the correlation between objective function value pairs in terms of admissible constraint pairs and the jointly Gaussian distribution of the observed and unobserved objective function values over the set of admissible constraints, D(s) in FIG. 8, the method predicts the mean value of the objective function and the uncertainty around that mean. The mean and uncertainty after three admissible constraint observations (D1, D2 and D3) are represented by the dotted line and hashed surface in FIG. 8. The latest knowledge of the mean and covariance of the objective function are used in order to estimate the unobserved constraint associated with the estimated optimum of the objective function. Dependent on the implemented strategy for further exploring the uncertain regions of the objective function (i.e. constraint values with high predicted variance) or exploiting the measurements in order to drive toward extrema of the objective function, the constraint associated with the estimated optima or another constraint associated with highly uncertain constraints is evaluated. Approximating the optimal constraint includes predicting the trajectory refinement using the explicit constraints defined in the chosen constraint vector while adhering to the performance and other aircraft-specific constraints implicitly captured in the trajectory predictor system (e.g. a flight management system or other trajectory predictor system). The trajectory refining system iteratively repeats the process of selecting a new constraint value for trajectory prediction, and thus observation of the objective function value at that constraint, updating the latest knowledge with the present observation, repredicting the Gaussian distribution of the objective function values over the set of admissible constraint and selecting an approximately minimizing constraint until convergence of the solution within a predetermined threshold. The predetermined threshold is any limit that effectively completes the iterative process including, but not limited to, a limit on computational budget (e.g. a total amount of time or number of computing cycles to be spent computing a refined trajectory for the given computational hardware), convergence to an extremum of the objective function, and exceeding a predetermined value of the objective function.

Technical effects of the above-described embodiments include a scalable and budget conscious trajectory optimization system that determines computationally tractable trajectory improvements across multiple platforms. Specifically, embodiments of the system and method described above could be implemented on-board the aircraft (e.g. FMS) or as part of a ground system.

The volume of trajectories that need to be predicted in order to evaluate and maximize the objective function is the main culprit behind the prohibitive computational cost that lead to the intractability of many optimization algorithms in aviation. To wit, prediction of a four-dimensional trajectory is done using the FMS or other Trajectory Predictor. Depending on the hardware implementation of the Trajectory Predictor, the number of free parameters in the optimization problem (optimization of the altitude profile of a single aircraft vs optimal re-routing of a fleet of aircraft) and the amount of time available for the determination of a solution, the optimization problem can quickly become intractable. Embodiments of the above-described system and method uses prior knowledge and inference to approximate an optimal solution in order to better deal with the factors that lead to intractability as discussed above. The sequential nature of the method also allows for a cap on the computation budget based on target hardware implementation, because, regardless of the computational budget, at the end of any iteration sequence, the solution is guaranteed to be at least as good or more optimal than the initial trajectory.

Embodiments of the system and method presented above could serve as the backbone for an airborne trajectory optimizer implemented on the Flight Management System (FMS) or as a ground based fleet optimization tool. Relating to the airborne implementation, embodiments of the system and method described above can be employed with a problem specific objective function to solve for optimum drift-up trajectories. The solution set, in this instantiation, would consist of an optimal set of along-path altitude constraints associated with the initial aircraft four-dimensional trajectories stored in the FMS. In a similar manner, an objective function suitable for path-stretching on-board the FMS can be optimized.

Regarding fleet optimization, embodiments of the system and method presented above can be used to perform trajectory routing considering sector traffic, weather, emissions and fuel burn or airline costs by fusing data available both in air and on the ground. The ground system has accurate information regarding sector weather, traffic and fleet-level goals. Meanwhile, knowledge of the exact performance capability of each aircraft is limited. In the air, the capabilities of the aircraft are known accurately, however, there is limited situational knowledge regarding traffic and weather. Using embodiments of the system and method described above, ground systems can perform a global optimization in the air-sector in order to select approximately optimum four-dimensional trajectory constraints for each aircraft in the fleet. Each individual aircraft, using the accurate performance data captured in the FMS would locally optimize the aircraft trajectory about the set of constraints provided by the ground. The demonstrated advantages of an air-ground-coupled-optimization solution would lend a strategic advantage to FMS-ground system fused systems.

To the extent not already described, the different features and structures of the various embodiments can be used in combination with each other as desired. That one feature is not illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of refining aircraft trajectories, the method comprising:

obtaining from a trajectory predictor, data related to a set of four-dimensional trajectories for aircraft;

determining by a constraint selector module a set of constraints as at least one point along the set of four-dimensional trajectories that bound the set of four-dimensional trajectories;

mapping in a processor values for a goal associated with the set of four-dimensional trajectories based on the determined set of constraints;

estimating in the processor additional values for the goal based on the mapped values for the goal associated with the set of four-dimensional trajectories;

repeating the obtaining, determining, mapping, and estimating steps until the value for the goal associated with the set of four-dimensional trajectories exceeds a predetermined threshold to determine a final set of constraints;

optimizing an aircraft trajectory based on the determined final set of constraints; and operating an aircraft according to the optimized aircraft trajectory;

wherein the predetermined threshold is a total amount of time or a number of computing cycles to be spent computing a refined trajectory.

2. The method of claim 1 wherein the step of determining the set of constraints further includes a step of selecting the set of constraints from a jointly Gaussian distribution over a set of observed and unobserved objective function values.

3. The method of claim 1 further including the steps of decreasing an uncertainty in the estimate of an objective function and selecting the set of constraints based on an estimated mean and uncertainty of the objective function.

4. The method of claim 1 wherein the values for the goal includes data related to aircraft weight, fuel burn vertical speed, ground speed, airspeed, temperature, turbulence or wind along the set of four-dimensional trajectories.

5. The method of claim 1 wherein the set of constraints are selected to refine a trajectory of the aircraft to conduct a path-stretch maneuver that alters a path length of the trajectory wherein aircraft speed is altered in order to minimize an objective function related to decreasing fuel consumption or minimizing operational cost.

6. The method of claim 1 wherein the set of constraints are selected to refine a set of trajectories to coordinate aircraft time-of-arrival across multiple aircraft in a fleet.

7. The method of claim 1 wherein the set of constraints include values related to altitude, latitude, longitude, expected time of arrival, or sequence.

8. A trajectory refining system, comprising:

a trajectory predictor for predicting data related to a set of four-dimensional trajectories for aircraft;

a constraint selector module for:

determining by the constraint selector module a set of constraints as at least one point along the set of four-dimensional trajectories that bound the set of four-dimensional trajectories;

mapping in a processor values for a goal associated with the set of four-dimensional trajectories based on the determined set of constraints;

estimating in the processor additional values for the goal based on the values for the goal associated with the set of four-dimensional trajectories mapped in the processor; and repeating the determining, mapping, and estimating steps until the value for the goal associated with the set of four-dimensional trajectories exceeds a predetermined threshold to determine a final set of constraints; and an update module coupled to the constraint selector module and the trajectory predictor and configured to obtain data related to a four-dimensional trajectory calculated by the trajectory predictor after every repeating completed by the constraint selector module wherein an aircraft trajectory is optimized based on the determined final set of constraints;

wherein an aircraft is operated by the trajectory refining system according to the optimized aircraft trajectory; and wherein the predetermined threshold is a total amount of time or a number of computing cycles to be spent computing a refined trajectory.

9. The trajectory refining system of claim 8 wherein the constraint selector module further determines the set of constraints from a jointly Gaussian distribution over a set of observed and unobserved objective function values.

10. The trajectory refining system of claim 8 wherein the trajectory predictor is integrated into a flight management system of the aircraft and the constraint selector module is integrated into a ground system or the aircraft.

11. The trajectory refining system of claim 8 wherein the trajectory predictor and the constraint selector module are both integrated into a ground system.

12. The trajectory refining system of claim 8 wherein the constraint selector module is configured to select the set of constraints to refine the trajectory of the aircraft to conduct a path-stretch maneuver wherein aircraft speed and path-length are altered in order to minimize an objective function related to decreasing fuel consumption or minimizing operational cost.

13. The trajectory refining system of claim 8 wherein the constraint selector module is configured to select the set of constraints to refine a set of trajectories to coordinate aircraft time-of-arrival across multiple aircraft in a fleet.

14. A method of refining a set of four-dimensional trajectories for aircraft, the method comprising:

obtaining from a trajectory predictor, data related to the set of four-dimensional trajectories for aircraft;

determining by a constraint selector module a set of constraints as at least one point along the set of four-dimensional trajectories that bound the set of four-dimensional trajectories;

mapping in a processor values for a goal associated with the set of four-dimensional trajectories based on the determined set of constraints;

setting in the processor estimations of additional values for the goal based on the mapped values for the goal associated with the set of four-dimensional trajectories;

repeating the obtaining, determining, mapping, and setting steps and adjusting the estimations until the value for the goal associated with the set of four-dimensional trajectories exceeds a predetermined threshold to determine a final set of constraints;

optimizing an aircraft trajectory based on the determined final set of constraints; and operating an aircraft according to the optimized aircraft trajectory;

wherein the predetermined threshold is a total amount of time or a number of computing cycles to be spent computing a refined trajectory.

15. The method of claim 14 wherein the set of constraints are selected to refine a trajectory of the aircraft to conduct a path-stretch maneuver where aircraft speed and path-length are altered in order to minimize an objective function relating to fuel or cost minimization.

16. The method of claim 14 wherein the set of constraints are selected to refine a set of trajectories to coordinate time-of-arrival across multiple aircraft in a fleet.

* * * * *